US006707395B1

(12) United States Patent
Greiff

(10) Patent No.: US 6,707,395 B1
(45) Date of Patent: Mar. 16, 2004

(54) CIRCUIT CONFIGURATION FOR POSITION LIGHTS

(75) Inventor: Karl Wilhelm Greiff, St. Goarshausen (DE)

(73) Assignee: aqua Signal Aktiengesellschaft, Bremen (DE)

( * ) Notice: Subject to any disclaimer, the term of this patent is extended or adjusted under 35 U.S.C. 154(b) by 0 days.

(21) Appl. No.: 09/959,135

(22) PCT Filed: Apr. 8, 2000

(86) PCT No.: PCT/EP00/03154

§ 371 (c)(1),
(2), (4) Date: Apr. 18, 2002

(87) PCT Pub. No.: WO00/63069

PCT Pub. Date: Oct. 26, 2000

(30) Foreign Application Priority Data

Apr. 16, 1999 (DE) ..... 199 17 256

(51) Int. Cl.[7] ..... G08B 23/00
(52) U.S. Cl. ..... 340/984; 114/382; 362/477
(58) Field of Search ..... 340/984, 985, 340/332; 114/39.11, 382; 362/477; 116/26

(56) References Cited

U.S. PATENT DOCUMENTS

| | | | | |
|---|---|---|---|---|
| 4,131,033 A | * | 12/1978 | Wright et al. | 200/336 |
| 5,072,362 A | * | 12/1991 | Lilienthal | 340/984 |
| 5,448,234 A | | 9/1995 | Harwood | 340/984 |
| 5,636,916 A | * | 6/1997 | Sokolowski | 340/984 |
| 6,473,005 B2 | * | 10/2002 | Showell | 340/984 |

FOREIGN PATENT DOCUMENTS

DE 0694403 7/1940

* cited by examiner

*Primary Examiner*—Brent A. Swarthout
(74) *Attorney, Agent, or Firm*—Sidley Austin Brown & Wood, LLP

(57) ABSTRACT

A circuit configuration for switching navigation lights of a watercraft, especially a sailing vessel, includes elements that prevent a position light configuration from not being in compliance with regulations as well as elements that prevent navigation lights that have mutually exclusive meanings from being switched on at the same time, and a single multiway switch (1) with which the navigation lights and additional lights, that are independent therefrom can be switched.

9 Claims, 7 Drawing Sheets

CIRCUIT CONFIGURATION FOR POSITION LIGHTS

BACKGROUND OF THE INVENTION

1. Field of the Invention

The application relates to a circuit configuration for switching navigation lights of a watercraft, especially a sailing vessel, comprising at least one switch. Of course, the invention is also correspondingly applicable to engine-powered vessels.

2. Description of the Prior Act

At night or in bad visual conditions watercraft must switch on navigation lights. By means of the navigation lights it is possible for an observer to decide from afar whether the watercraft is anchored, is moving, in which direction it is moving, and/or whether it is power driven. Also, additional information can be communicated, for example in regard to whether the watercraft is partially or completely incapable of maneuvering, or, if it is a fishing vessel, whether it has cast nets or is trawling.

The navigation lights include a forwardly oriented white masthead light and an aft oriented white stern light as well as two sidelights, of which a red one indicates the port side and a green one indicates the starboard side of the watercraft. The latter can also be combined in a lantern. Moreover, the navigation lights include, inter alia, a white anchor light, a yellow trawling light, quick flashing lights, as well as white, red and green all-round lights.

At night, a sailing vessel must have switched on the sidelights and the stern light when it is moving and thus is neither anchored not incapable of maneuvering. Instead of these navigation lights, a three-color lantern can be positioned on the masthead when a sailing vessel up to 20 m length is not operated under engine power.

As soon as the sailing vessel is assisted by the engine, the sidelights, the masthead light and the stern light must be switched on in any case, regardless of whether the sailing vessel is moving at the same time under sail or not. A three color lantern as well as, optionally, the also permissible all-round lights (red over green) would have to be switched off in this situation.

The activation of the masthead light is of special importance inasmuch as it is important for the determination of right-of-way rules. Accordingly, a power driven sailing vessel must always yield to a craft powered only by sail.

When a watercraft is anchored, one or more anchor lights must be switched on, depending on its length. In this case, the masthead light, stern light, and sidelights must be switched off.

It is conventional to secure each of the navigation lights individually by means of an automatic circuit-breaker. In this way, the regulations, for example, those of Germanische Lloyd, for watersport crafts are complied with.

Since in this way, the navigation lights can be switched independently of one another, it is possible that navigation lights with contradictory information are switched on at the same time, or that a light configuration that is not in compliance with regulations and/or is insufficient is activated. When in the case of a watercraft, for example, the masthead light and stern light are illuminated without the sidelights being switched on, this could be interpreted from afar as an anchored vessel which could have disastrous consequences.

It is an object of the invention to provide a circuit configuration of the aforementioned kind, with which a maloperation is prevented, which provides a simplified operation, and which fulfills the existing regulations.

SUMMARY OF THE INVENTION

The problem is solved my means which prevent switching on at the same time lights which have mutually exclusive meanings as well as exclude a light combination not being in compliance with regulations, i.e. also incomplete.

For this purpose, different means can be used. For example, it is possible to employ toggle switches arranged adjacent to one another for switching on the anchor light, the sidelights as well as the masthead light and the stern light, respectively, wherein the switch for the masthead light and the stern light is provided with a driver which ensures that, when switching it on, the sidelights are also switched on, if this has not been done previously.

At the same time, the toggle switch for the sidelights can be provided with a driver which ensures that the switch for the anchor light is switched off when switching on the sidelights. The function of the driver can be assumed by an electrical or electronic circuit. By doing so, a possible maloperation is safely prevented and at the same time, the operation is simplified because the anchor light is automatically switched off when switching on the sidelights or the masthead light or the stern light.

In a particularly simple embodiment, the circuit configuration has a multiway switch (for example, combined rotary push-pull switch) with at least two switching positions. In this connection, each switching position corresponds to one operational state of the watercraft, wherein by means of the multiway switch in one switching position all navigation lights required for a certain operational state are switched on and all other navigation lights are switched off. This provides the added advantage that it is no longer required to protect each position light individually by a fuse, but instead, protection of the circuit by a single fuse for all navigation lights is sufficient because the navigation lights are supplied with current by a single switch. Accordingly, at least four circuit breakers are saved, in general.

In particular, in addition to an off position, the multiway switch can comprise a switching position for switching the navigation lights to indicate that the watercraft is moving. In this switching position the sidelights and the stern light are switched on for a sailboat. For a engine-powered vessel sidelights, masthead light and stern light should be switched on simultaneously.

In particular for sailing vessel it is advantageous when a further switching position is provided for the navigation lights to indicate that the watercraft is power driven. In this switching position for a sailing vessel, the masthead light is switched on simultaneously in addition to the sidelights and the stern light.

In these two switching positions it is expedient when a functional illumination of the deck is switched on simultaneously with the switching of the navigation lights. The functional illumination can be, in particular, a compass illumination, an instrument illumination and/or an passageways illumination. In this case it is expedient when the functional illumination is supplied with current by a different circuit than the navigation lights.

Finally, the multiway switch should have a switching position for switching the navigation lights to indicate that the watercraft is anchored. In this switching position, only the anchor lights are switched on while the other navigation lights are switched off.

Furthermore, switching positions for indicating that the watercraft is partially and/or totally incapable of maneuvering, may be provided. In this case, the sidelights are switched off and—in the case of partial inability to maneuver—two red all-round lights are arranged atop one another and a white all-round light positioned therebetween, or—in the case of complete inability to manoeuver—only two red all-round lights positioned above one another are switched on.

In a preferred embodiment the multiway switch is a rotary switch. A rotary switch has a special advantage in comparison to a linearly actuated toggle switch in that the switching position cannot be easily changed accidentally because in order to actuate it, torque must be exerted onto the switch instead of a directed force.

The rotary switch can have additional switching planes switchable upon pull action and/or push action. Such switches are, for example, known in automobiles for switching on the light wherein by means of a rotary position the low beams or the high beams can be switched on and, additionally, the fog tail light or the fog beams can be switched on by changing a switching plane by pulling on the switch. In the present case, by means of the different switching planes, additional consumers of the watercraft can be switched on, for example, the deck illumination or the cockpit illumination. However, for safety reasons attention must be paid that switching of the switching planes has no effect on the switching of the navigation lights in order to prevent an accidental switching of the navigation lights.

Also, attention must be paid that the additional consumers, as well as the functional illumination, are not supplied with current via the circuit for the navigation lights.

In another preferred embodiment, the multiway switch is watertight so that it can be used in the cockpit on deck. In another preferred embodiment of the invention, the circuit configuration comprises a logic circuit which automatically switches the navigation lights as a function of the operational state of the watercraft.

BRIEF DESCRIPTION OF THE DRAWINGS

In the following, the invention will be explained in more detail by means of the description of a preferred embodiment illustrated in the attached drawings.

DETAILED DESCRIPTION OF THE PREFERRED EMBODIMENT

Figure 1:
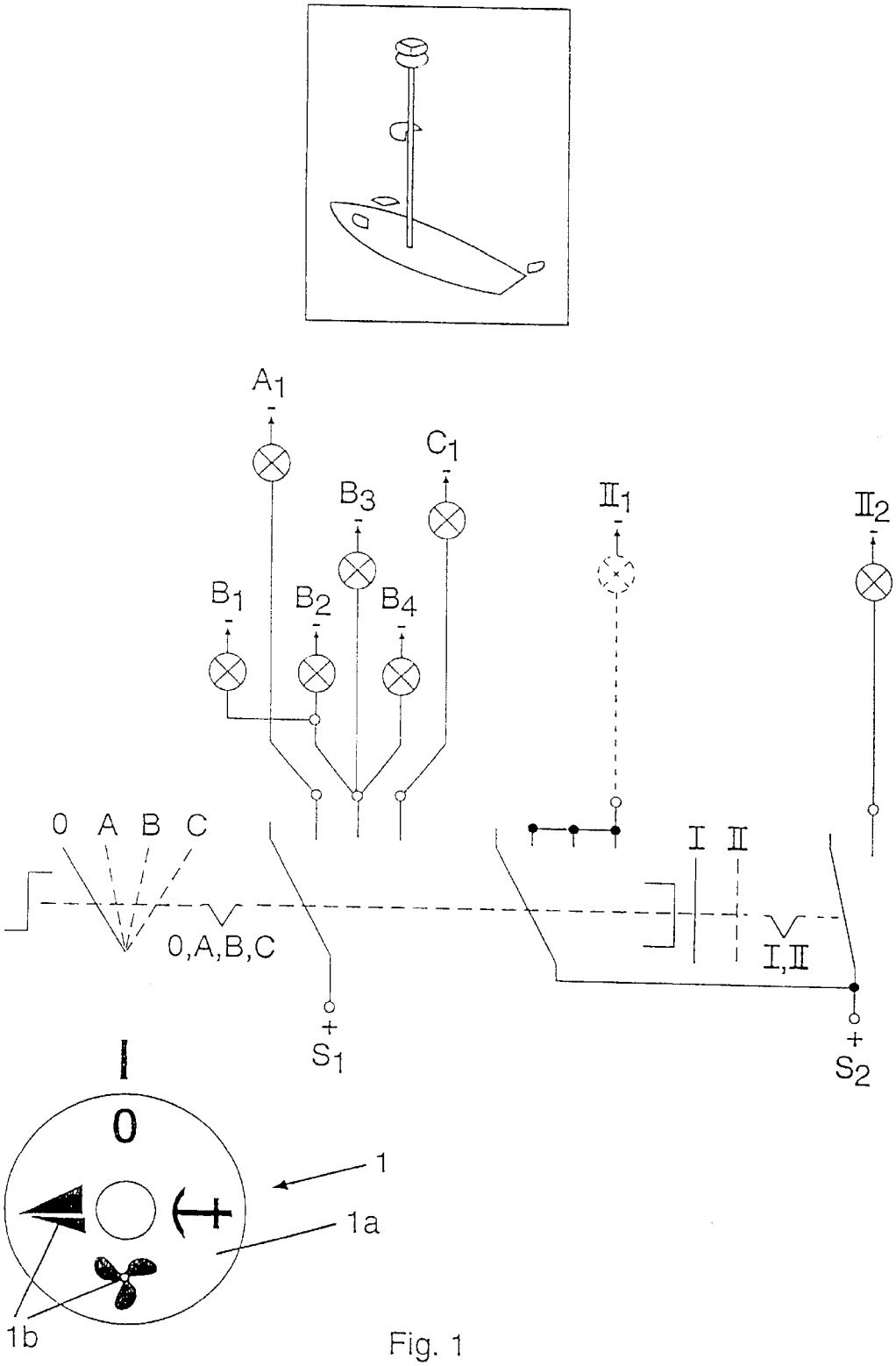
FIGS. 1 to 7 show the circuit diagram of a circuit configuration for a sailing vessel with a rotary switch with two switching planes and various switching positions.

FIG. 1 shows a circuit diagram of a circuit configuration for switching navigation lights of a sailing vessel with a rotary switch 1 in a switching position 0, in which all navigation lights are switched off. A rotary switch 1 comprises an axially movable shaft (not illustrated), on which a display disk 1*a* is secured which thus follows the movements of the shaft and is provided with symbols 1*b* which show the operator in an obvious way the different vessel situations that are possible.

By means of this circuit configuration, on the one hand, a three-color lantern $A_1$, red and green sidelights $B_1$, $B_2$, a white masthead light $B_3$, and a white stern light $B_4$ as well as an anchor light $C_1$ are switchable by rotation via the switching positions A, B, and C. In this, switching position A corresponds to the illustration of a sail on the display disk 1*a* of the rotary switch 1, switching position B corresponds to the configuration of a propeller, and switching position C corresponds to the illustration of an anchor.

All navigation lights are switchable independently of other consumers and are protected by a fuse $S_1$.

Moreover, by changing the switch from a first plane I into a second plane II further consumers can be switched. In particular, this can be the deck illumination $II_2$. Even though the deck illumination is switched by the same switch, it is, however, connected, to a separate circuit and protected by its own circuit breaker $S_2$, as is functional illumination $II_1$.

Figure 2:
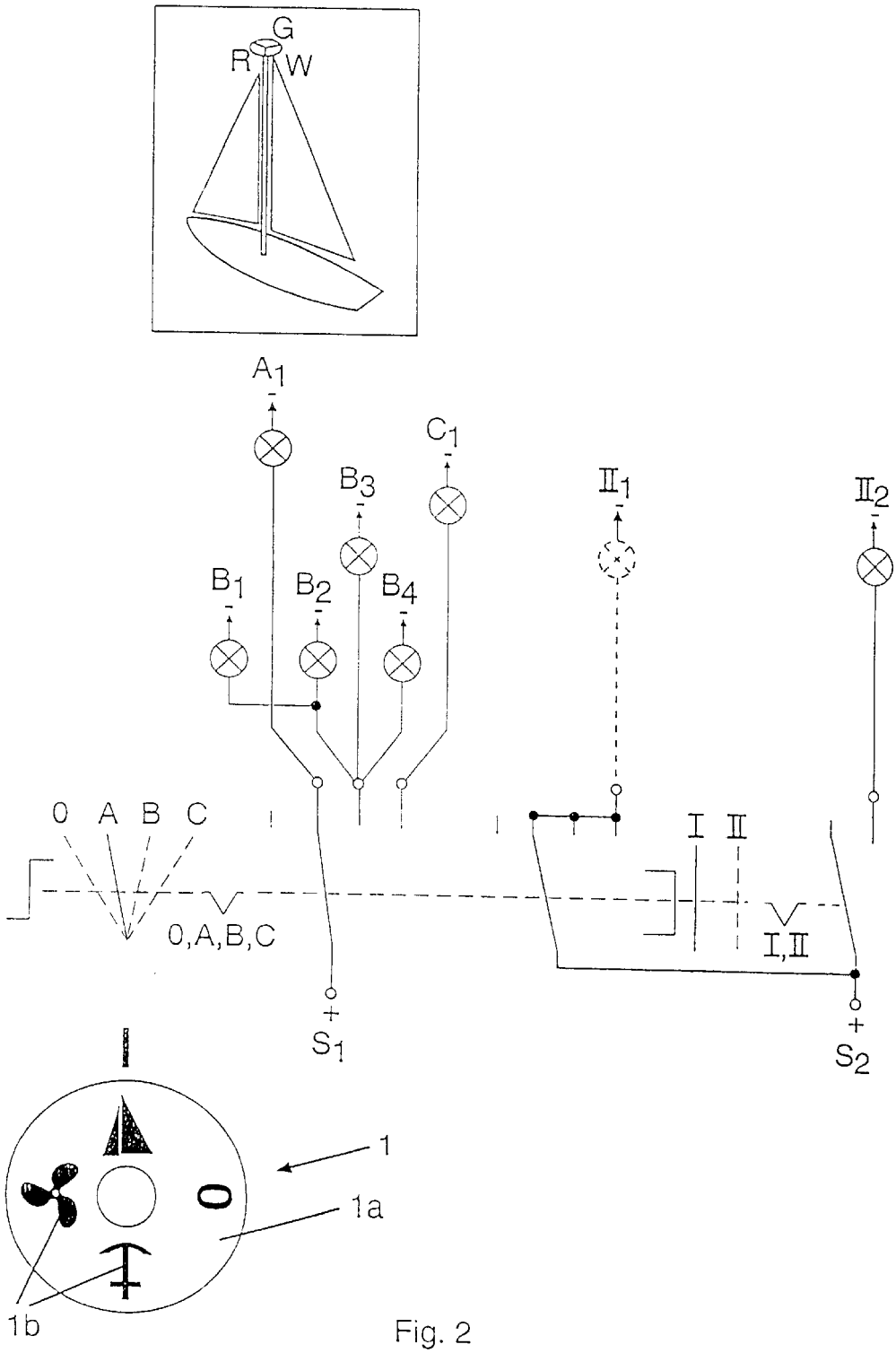
Figure 3:
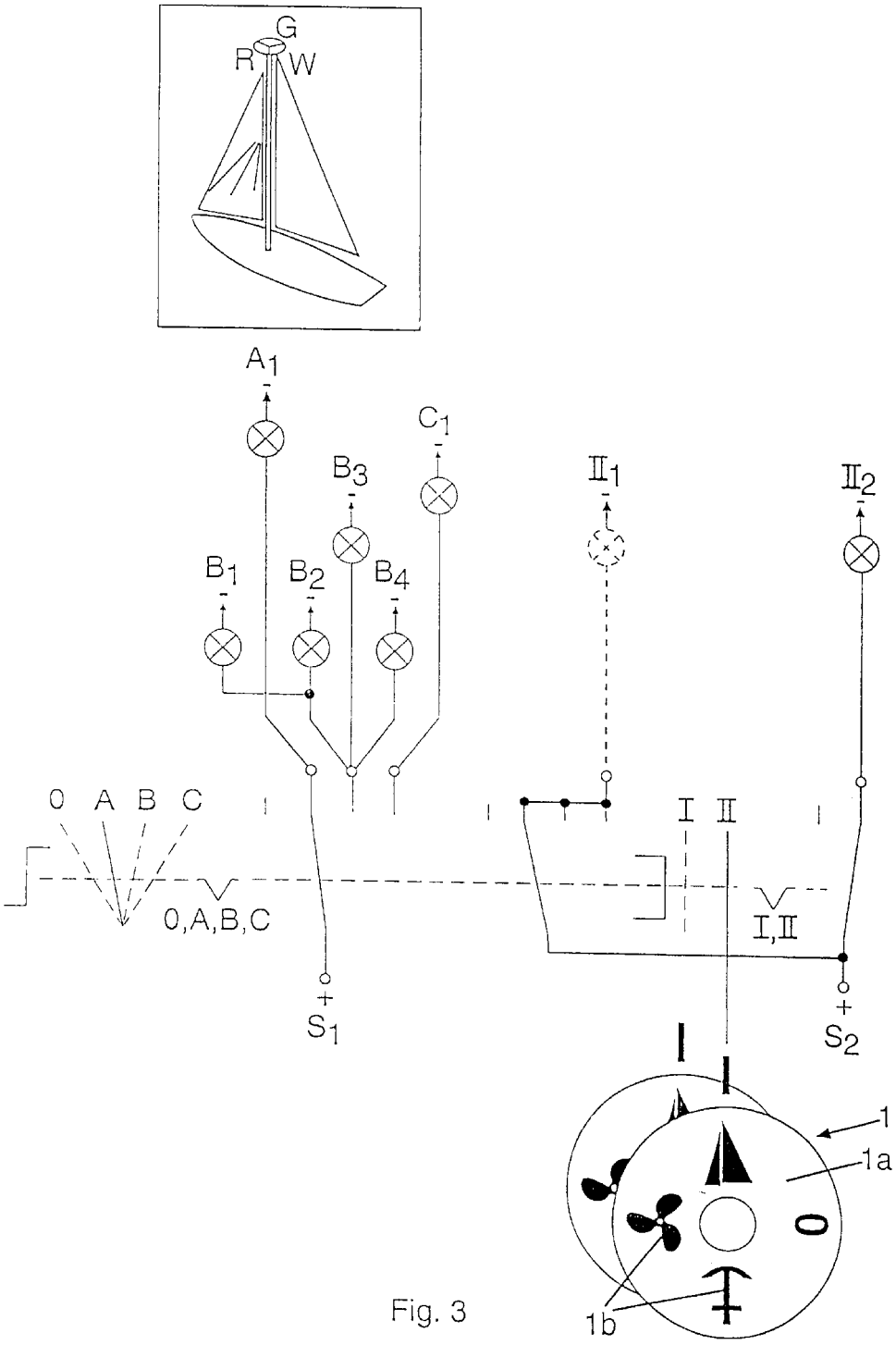

FIGS. 2 and 3 show that in a first switching position A, the three-color lantern $A_1$ is switched on.

Figure 4:
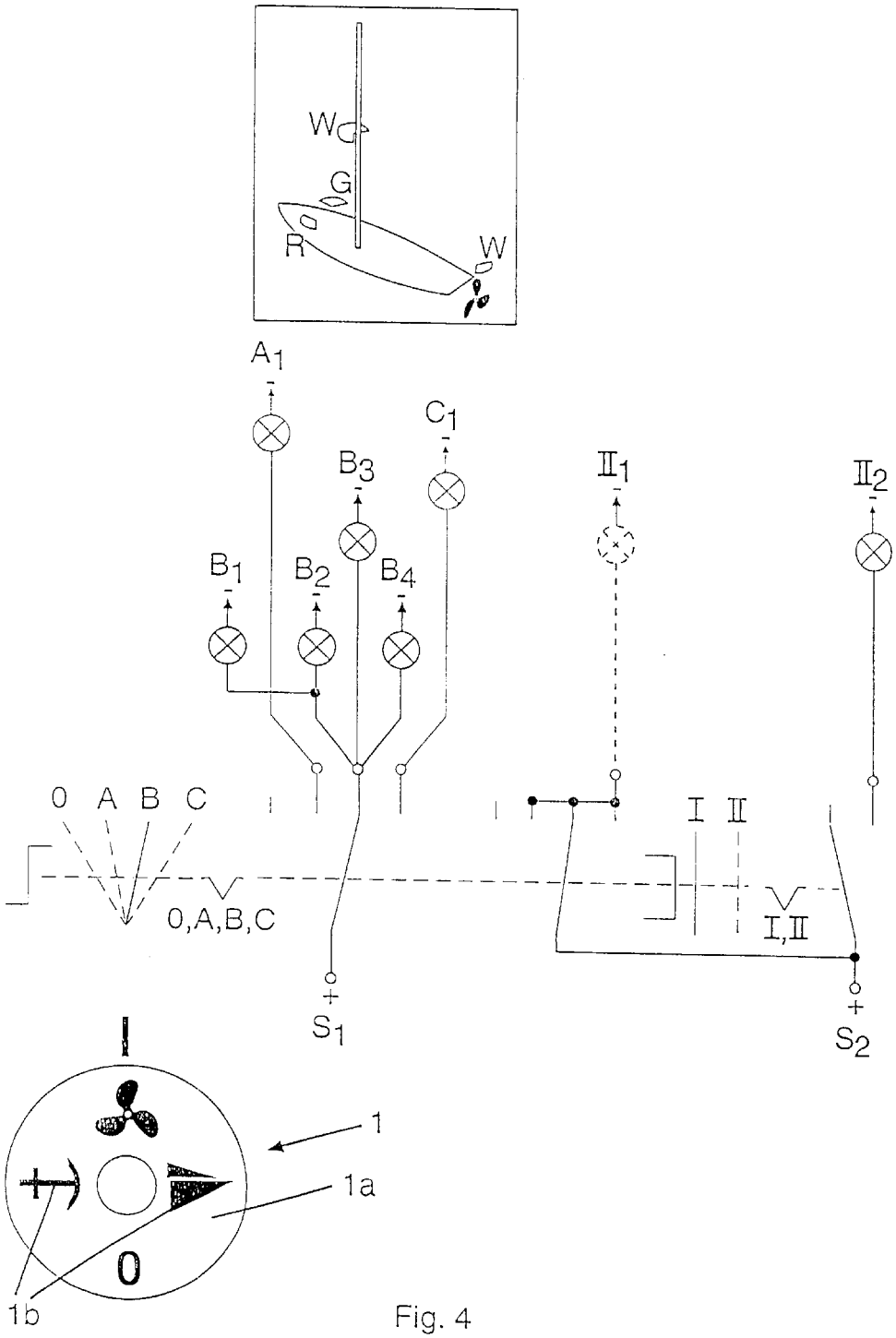
Figure 5:
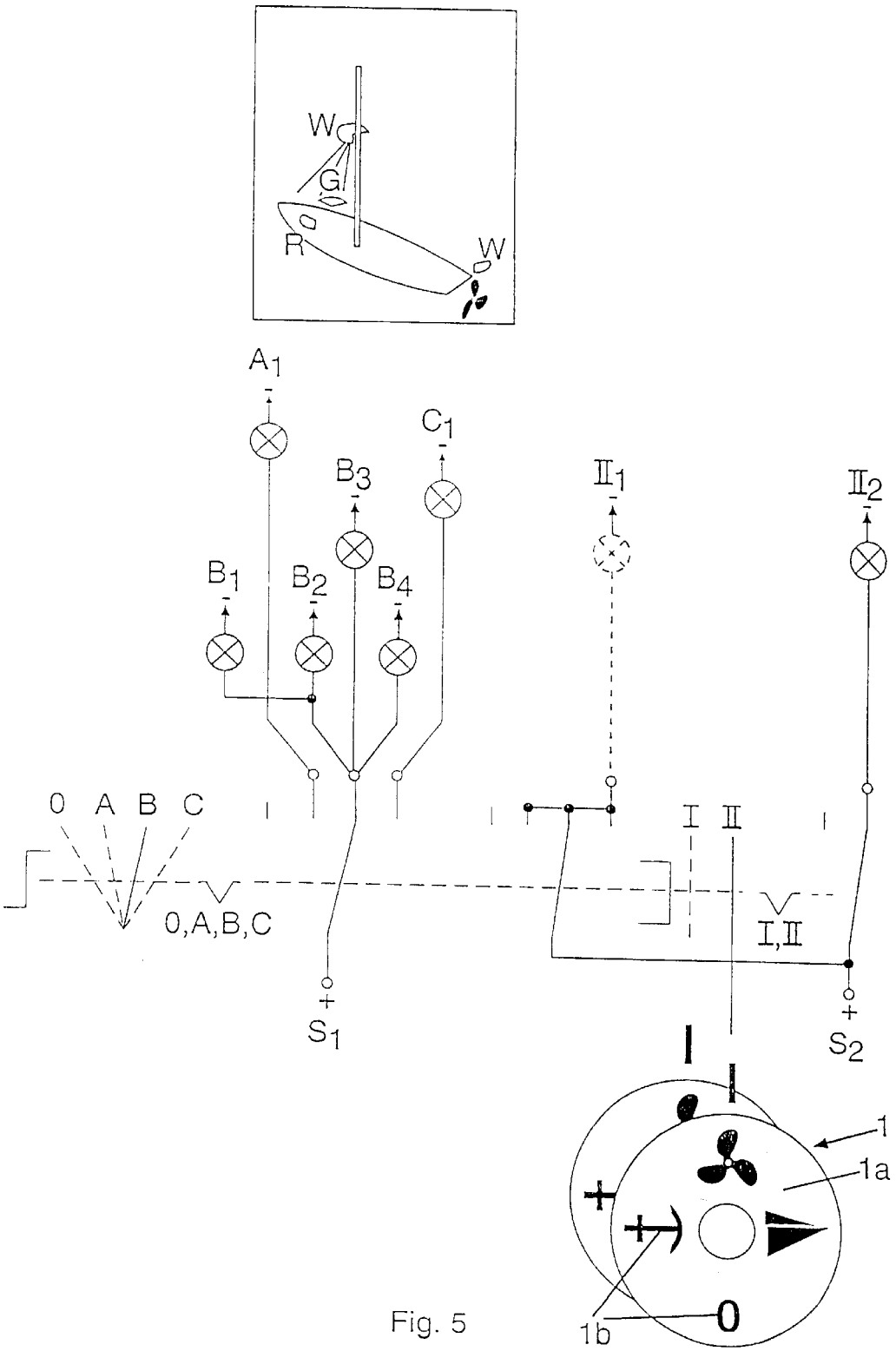

FIGS. 4 and 5 show the circuit configuration in switching position B. The three-color lantern $A_1$ is switched off here. Instead, the sidelights $B_1$, $B_2$ as well as the masthead light $B_3$ and the stern light $B_4$ are switched on. Also, the functional illumination $II_1$ is switched on in this situation. In the state according to FIG. 4, the deck illumination is switched off.

In the switching positions A and B, the required functional illumination $II_1$ is automatically switched on when switching the navigation lights on.

Figure 6:
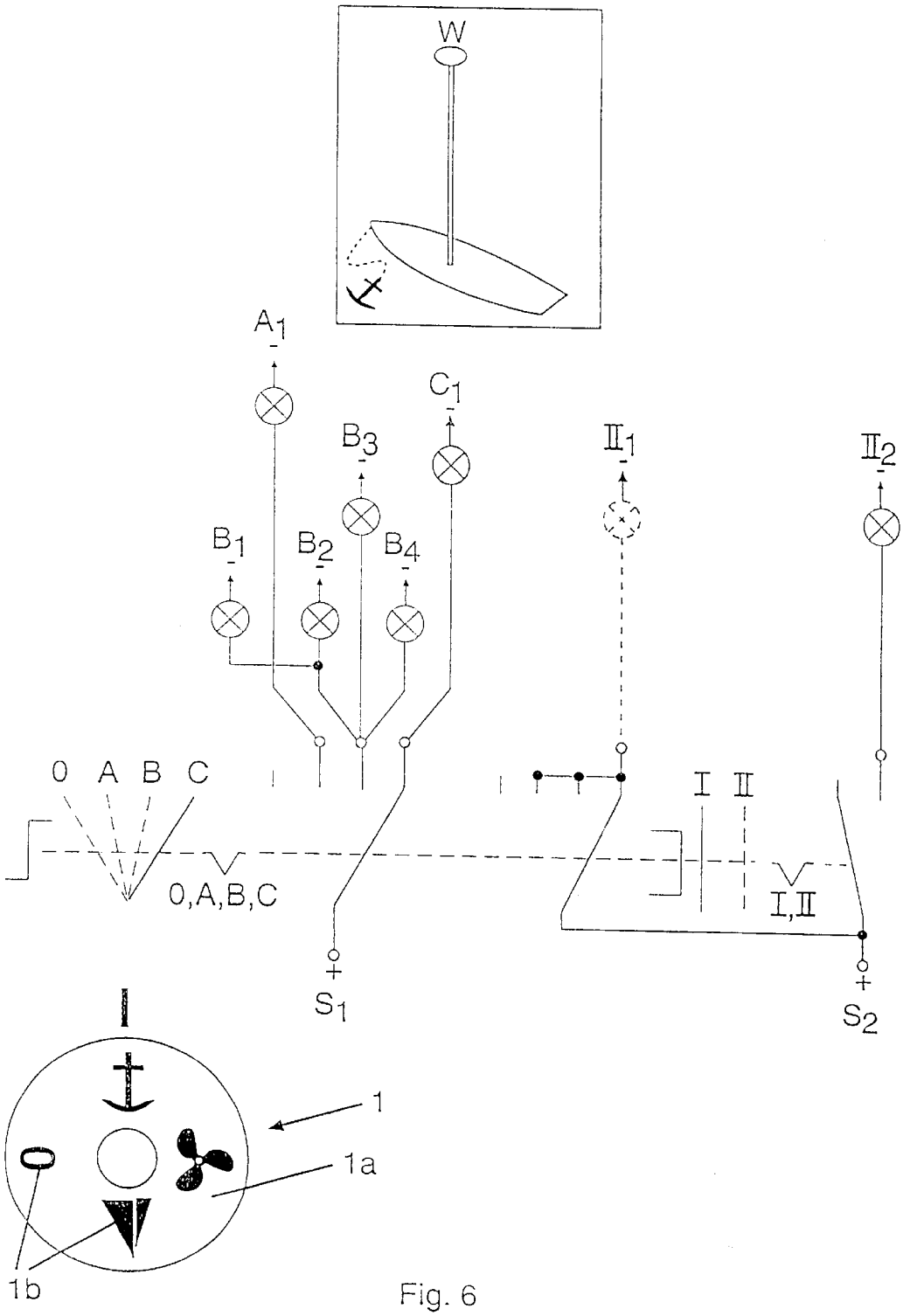
Figure 7:
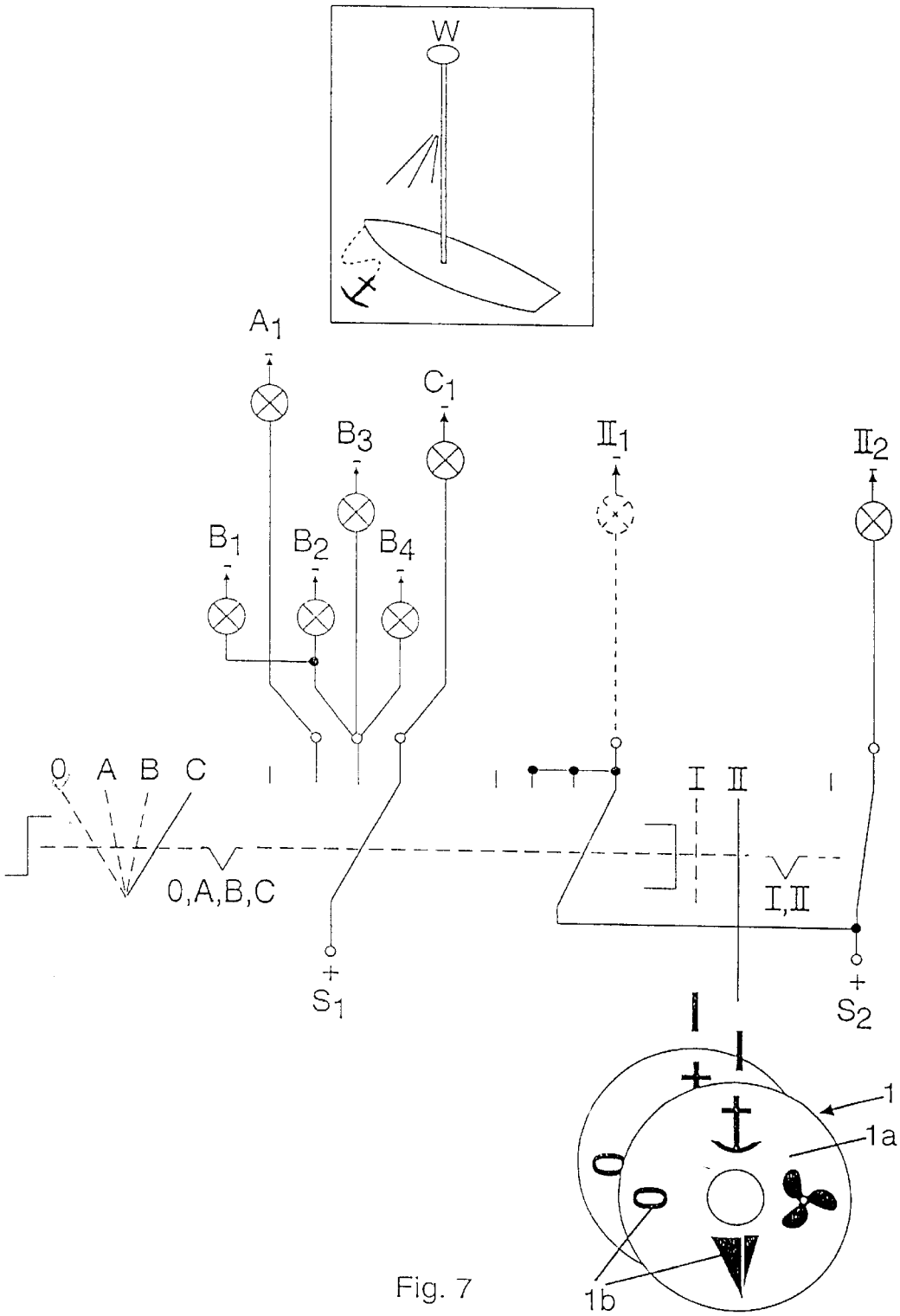

In the switching position C illustrated in FIGS. 6 and 7, only the anchor light $C_1$ of the navigation lights is switched on. Depending on the embodiment of the circuit configuration, the functional illumination $II_1$ can be switched on or off in this switching position.

Finally, in FIGS. 3, 5, and 7 it can be seen that in each of the switching positions A, B, C, the deck illumination $II_2$ is switched on as soon as the rotary switch 1 is moved through pulling or pushing from the first switching plane I into the second switching plane II.

With a circuit configuration according to the invention it is possible that all functions which are required for switching the lights above the deck of a watercraft are combined within only one switch and that the switching of the lights can be carried out in a way which complies with the regulations, excludes errors, and is facilitated by the display symbols.

What is claimed is:

1. A circuit configuration for switching navigation lights of a watercraft, especially a sailing vessel, comprising means that prevent a position light configuration from not being in compliance with regulations as well as means that prevent navigation lights that have mutually exclusive meanings from being switched on at the same time, characterized in that the circuit configuration comprises a multiway switch (1) with which the navigation lights as well as additional lights, that are independent therefrom and at least one of directly correlated and indirectly correlated with the watercraft ($II_1$, $II_2$), can be switched; in that the multiway switch (1) has at least two switching positions (0, A, B, C), with one switching position (A) for switching the navigation lights to indicate that a sailing vessel is moving; and in that via each of the switching positions (A, B, C), at least one of a functional illumination on, under deck, and external to the watercraft can be switched, in particular, a compass illumination, instrument illumination, or passageways illumination.

2. A circuit configuration according to claim 1, characterized in that the functional illumination is supplied with current by a different circuit than the navigation lights.

3. A circuit configuration according to claim 1, characterized in that the multiway switch (1) is formed as a combined rotary push-pull switch.

4. A circuit configuration according to claim 1, characterized in that, in addition to the switching positions (0, A, B, C), a deck illumination is switched by a circuit, which is independent of the navigation lights, by switching from one switching plane (I) to another switching plane (II).

5. A circuit configuration according to claim 1, characterized in that the multiway switch comprises different switching planes switchable upon at least one of pull action and push action.

6. A circuit configuration according to claim 1, characterized in that the multiway switch is watertight.

7. A circuit configuration according to claim 1, characterized by at least one display disk (1*a*).

8. A circuit configuration according to claim 7, characterized in that the display disk (1*a*) is fixedly secured on a switch shaft.

9. A circuit configuration according to claim 7, characterized by symbols (1*b*) on the display disk symbolizing the possible various craft situations.

* * * * *